United States Patent [19]

Frietzsche et al.

[11] 4,101,280

[45] Jul. 18, 1978

[54] APPARATUS FOR PURIFICATION OF WASTE FROM COMBUSTION ENGINES

[75] Inventors: Gunther Frietzsche, Edenkoben, Pflaz; Peter Krause, Hochstadt; Christian Schulten, Dudenhofen, all of Germany

[73] Assignee: Paul Gillet GmbH, Edenkoben, Pfalz, Germany

[21] Appl. No.: 748,047

[22] Filed: Dec. 6, 1976

[30] Foreign Application Priority Data

Dec. 24, 1975 [DE] Fed. Rep. of Germany ... 7541252[U]

[51] Int. Cl.[2] ..... B01J 8/02; F01N 3/15

[52] U.S. Cl. ..... 23/288 FC; 23/288 F; 23/277 C; 60/299; 60/301; 55/DIG. 30

[58] Field of Search ..... 23/288 FC, 288 P; 60/299, 301; 55/DIG. 30

[56] References Cited

U.S. PATENT DOCUMENTS 3,841,842 10/1974 Wiley ..... 23/288 FC 3,854,888 12/1974 Frietzsche et al. ..... 23/288 FC 3,992,157 11/1976 Stutel ..... 23/288 FC

*Primary Examiner*—James H. Tayman, Jr.

*Attorney, Agent, or Firm*—Orville N. Greene; Frank L. Durr

[57] ABSTRACT

A monolithic type of catalyst carrier for the exhaust system of a combustion engine is securely held in a tubular metal housing under the variations in temperature of operation by surrounding the monolith with a jacket, which extends between the monolith and the casing, and which has a thermal expansion coefficient that is equal to or greater than the difference between the thermal expansion coefficient of the monolith and that of the metal of the casing. The tubular casing also has tubular conduits on both ends with gradually decreasing diameters as the distance from the casing increases. Packing rings are provided between the peripheral edges of the monolith and the ends of the connected tubular conduits. Preferably, also, the end peripheral edges of the monolith are further protected by a flanged metal ring of which the flanged portions extend over a portion of the periphery at the ends of the monolith.

5 Claims, 3 Drawing Figures

APPARATUS FOR PURIFICATION OF WASTE FROM COMBUSTION ENGINES

Figure 1:
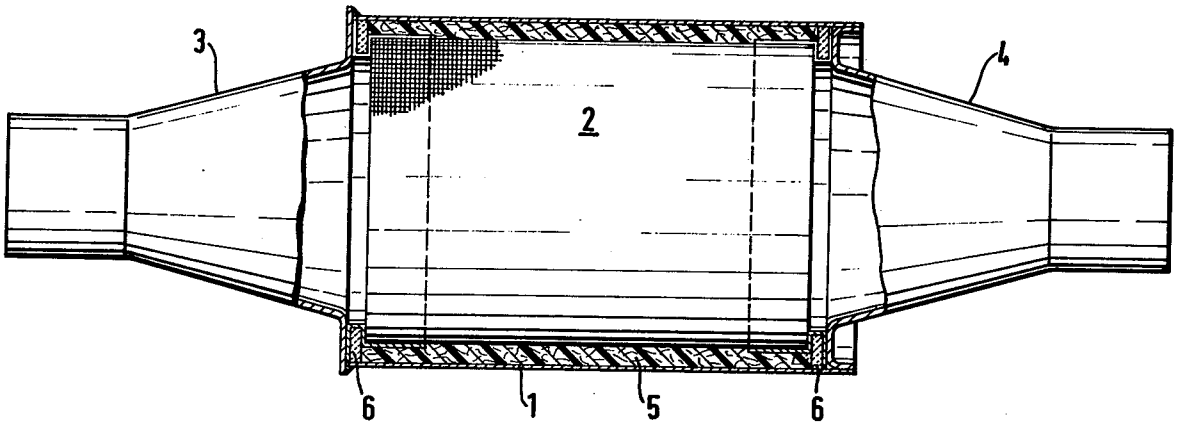

The invention concerns an apparatus for purification of waste or exhaust gases of combustion engines with at least one catalyzer carrying block (monolith) held in a metal housing through which the waste gas passes. With this arrangement, the main thing is that the monolith or monoliths be suppported perfectly in the radial as well as in the axial direction. Therefore, above all, the temperature fluctuation to which the apparatus is subjected must be taken into consideration, whereby the exceptionally large difference in the thermal expansion coefficients of the different parts must be considered. Besides, there occurs, when the apparatus is built into an automobile, not insignificant stress of a mechanical kind from that which originates from the shaking occurring in driving to others which are caused by the high frequency pulsating gas flow.

Accordingly, a series of proposed solutions have already been made in order to deal with the occurring problem of seating the monolith in the metal housing. Thus, i.e., in the proposal of German Pat. No. 1,476,507, the monolith is surrounded with a sheaf of corrugated material, either of corrugated sheet metal or of corrugated wire mesh and the monolith, as also the sheet of corrugated material, is reinforced on both sides of a front-sided flange inwardly directed from the metal housing.

According to German Offen, No. 2,213,539, it is known to provide for depositing the monolith through a yieldable elastic gastight layer of fire resistant mineral fiber which surrounds the entire surface of the monolith and which, for the installation, is curved over the front sides towards the interior. Thereby, between the said layer and the monolith, protective sheath of cement or a putty mass of suitable composition is provided.

The German Offen. No. 2,243,251, a support can be derived in which a ring-form part of metal strip and a sheet metal ring are provided in the front edge regions of the monolith. These ring-form parts are formed as stampings from steel, expecially stainless steel wire, which satisfies the requirements for satisfactorily supporting the monolith in the radial direction, as well as in the axial direction.

Finally, it is known from German Offen. No. 2,245,535 to provide an elastic sheath for the monolith in the shape of a body formed from metal strip which surrounds the sheath as well as the front edge area of the monolith, if necessary, under residual stress, and can undergo different partitioning and supplements.

While the first name state of technique is unsatisfactory because there, no elastic positioning in the axial direction is possible, in this direction the mechanical stress transferred directly from the gas current occurs; the other inventions mentioned offer an elastic mounting in the axial direction. The prior provided means are certainly susceptible to essential improvement; the problem to come under consideration first of all is to improve and simplify the proportions of the support of the monolith or monoliths.

The invention solves the problem by an arrangement for purifying waste gases of combustion engines with at least one catalyst carrier block (monolith) through which the waste gas is passed and which is supported in a metal housing by a surrounding jacket extending between the outer surface of the monolith and the housing, and that this jacket consists of a material with a thermal expansion coefficient and/or a deflection rate which is greater than the difference between the thermal expansion coefficient of the monolith on the one hand and the metal housing on the other hand.

This jacket can, e.g., consist of a so-called spring matting, which satisfies the aforementioned requirements as to thermal expansion coefficients. Felt-like products of this type, from plastics of essentially ceramic materials, are known, which have this type of large thermal expansion coefficients.

Another possibility consists in making a jacket from a prestressed mineral wool body which has the necessary springiness. It is possible, e.g. to compress a conventional mineral wool matt having a weight of about 200 $g/dm^3$ several times, e.g. to a weight of 7–800 $g/dm^3$. A jacket for the monolith formed from this mineral wool compressed body has the required properties.

This jacket suffices to give around the monolith, as well in the radial direction as in the axial direction, the necessary lasting solid set at all temperatures. Nevertheless, in the front edge area of the monolith, additional thrust protection in the form of packing rings from temperature resistant materials, e.g. metal-asbestos, can be provided, which monoliths are surrounded by a split supporting and protecting ring of sheet metal, which is arranged essentially between the packing ring and the surface of the monolith.

By a preferred embodiment, this supporting and protecting ring can largely span the packing ring and be provided with the flange for fitting over the surface of the monolith.

In place of the packing rings of e.g. metal-asbestos, a ring formed of stamped tangled wire can be used which just as simply takes over the problem of axial thrust protection and the protection of the jacket against exhaust discharge.

The invention will be further explained in the following description of a reproduced embodiment of the invention as shown schematically and by way of example in the annexed drawings, wherein.

FIG. 1 shows an apparatus made according to the invention.

Figure 2:
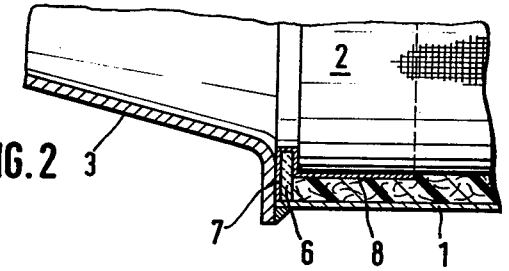

FIG. 2 reproduces a corner range of the device of FIG. 1 on an enlarged scale.

Figure 3:
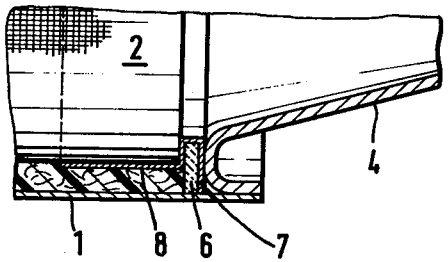

FIG. 3 shows another corner range of a device similar to FIG. 1, but with a modified form of the houding body.

In FIG. 1, a monolith 2 is provided in the housing 1. In place of this single monolith, several monoliths can be inserted in succession. The housing 1 is completed by two end conduits 3 and 4, which equilaterally diminish in cross-section to provide a connection for the tubes of the engine in which the apparatus is installed.

On the radial as well as in the axial supporting of the monolith 2 in housing 1, a jacket 5 is provided which fills the ring space between housing 1 and monolith 2. This jacket consists here of a material which has either a high heat expansion coefficient or a springiness or deflection rate that secures a satisfactory seating and mounting of the monolith in the housing at all occurring temperatures. For this purpose, the jacket can consist either of a so-called spring matt which has a higher heat expansion coefficient than that of the steel of the housing. This results in that, under the heat effect, the radial bedding pressure on the monolith, notwithstanding the sheet metal housing has a heat expansion coefficient significantly higher than the monolith, is at least maintained and if necessary, even strengthened.

There are known materials of ceramic or synthetic fibers which have this kind of properties.

One such possibility consists of a jacket 5 of a shaped body of pretensioned mineral wool which has a large padding weight, such that it is equipped with a springiness that likewise suffices to equalize the expansion difference between the monolith and the sheet metal housing due to the different heat expansion coefficients. For this, for example, long fibrous basalt wool can be provided which has a density greater than 500 g/dm$^3$, such as sold in Germany under the trademarks "Mevo Steinwolle", "Basalan", "Silan", or "Kerlan".

With the described jacketing, it is possible to support the monolith radially as well as in the axial direction. An additional seating in the axial direction is no longer required.

Nevertheless, it is advantageous to provide packing rings 6, which are arranged in the end edge regions of the monolith between the monolith and the adjacent opposing area of the end housing conduits 3. These sealing rings can be made of a special material which is heat resistant to over 1100° C, e.g. a fabric or rope formed of asbestos and fine metal wire or also a high heat resultant metal wire knit. These packing rings serve essentially to reduce the exhaust on the jacket and to operate as protection against axial thrust.

Between monolith 2 and the packing ring 6, a sheet metal ring 7 can be provided with advantageously, as shown in the drawing, largely span the packing rings 6 and extend, with flange 8, over a certain area of the surface of the monolith 2. This split, sheet-metal ring, serves to improve the combining of the different parts, furthermore, it centers the packing ring in relation to the monolith.

With such structure, it is also possible to accomplish the seating of the monolith in the housing and the production of all parts independently in one operation and test the whole system through a definite squeezing pressure and then in a further independent operation, to put on the housing ends 3 without the possibility that any part thereof could fall out.

The zone of each end 3 which cooperates with the packing ring 6 can either be built to connect with the housing 1 as shown in FIG. 2 or it can also be connected to the housing 1 as shown in FIG. 3.

I claim:

1. In an apparatus for the purification of exhaust gases from combusion engines which comprise at least one monolithic catalyzer block retained within a tubular metal housing, the improvement comprising jacketing means consisting essentially of compressed fibrous ceramic matt material completely surrounding the monolithic catalyzer whereby to take up radial as well as axial bearing forces acting on the monolithic catalyzer, said jacketing means being formed of a material having a residual expansionability that is at least equal to the difference between the thermal expansion coefficient of the monolith and that of the metal of the housing, a pair of end packing rings of refractory material, one at each end of said jacketing means, extending over the end area of the jacketing means and around a peripheral portion of the monolith, a pair of slitted rings of sheet metal, one supporting each packing ring, each of said slitted rings comprising a flange portion which surrounds an end portion of the monolith.

2. The apparatus as claimed in claim 1 wherein the jacket is made of a spring matt with thermal expansion coefficient which is at least equal to the difference between the thermal expansion coefficient of the monolith and that of the metal of the housing.

3. The apparatus as claimed in claim 1 wherein said jacket is made of shaped body of pretensioned mineral wool.

4. The apparatus as claimed in claim 1 wherein said packing ring is formed of a fabric material comprising asbestos supported on fine wire.

5. In an apparatus for the purification of exhaust gases from combusion engines which comprise at least one monolithic catalyst block retained within a tubular metal housing, the improvement comprising jacketing means surrounding the monolithic catalyst block filling in the radial space between the catalyst block and the tubular metal housing, said jacketing means consisting essentially of a mineral wool matt having a normal weight of about 200 g/dm$^3$ which has been compressed to a weight of about 700–800 g/dm$^3$, a pair of end packing rings of refractory material, one at each end of said jacketing means, extending over the end area of the jacketing means and around a peripheral end portion of the monolith, a pair of slitted rings of sheet metal, one supporting each packing ring, each of said slitted rings comprising a flange portion which surrounds an end portion of the monolith.

* * * * *